US010975815B2

(12) United States Patent
Robel et al.

(10) Patent No.: US 10,975,815 B2
(45) Date of Patent: Apr. 13, 2021

(54) FUEL INJECTOR AND FUEL SYSTEM WITH VALVE TRAIN NOISE SUPPRESSOR

(71) Applicant: Caterpillar Inc., Deerfield, IL (US)

(72) Inventors: Wade James Robel, Dunlap, IL (US); Thomas Jeffrey Crowell, Germantown Hills, IL (US); Lifeng Wang, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 26 days.

(21) Appl. No.: 15/985,170

(22) Filed: May 21, 2018

(65) Prior Publication Data

US 2019/0353125 A1 Nov. 21, 2019

(51) Int. Cl.
*F02M 55/04* (2006.01)
*F02M 45/04* (2006.01)
*F02M 59/36* (2006.01)

(52) U.S. Cl.
CPC ..... *F02M 55/04* (2013.01); *F02M 45/04* (2013.01); *F02M 59/366* (2013.01); *F02M 2200/09* (2013.01)

(58) Field of Classification Search
CPC ..... F02M 55/04; F02M 45/04; F02M 49/366; F02M 2200/09; F02M 57/026
USPC ..... 239/5, 88, 90, 533.3, 533.8, 533.9
See application file for complete search history.

(56) References Cited

U.S. PATENT DOCUMENTS 3,115,304 A * 12/1963 Humphries ..... F02M 57/02 239/90
5,287,838 A * 2/1994 Wells ..... F02M 59/462 123/467
5,505,384 A * 4/1996 Camplin ..... F02M 45/12 239/533.5
5,743,237 A * 4/1998 Matta ..... F02M 45/08 123/496
5,797,427 A * 8/1998 Buescher ..... F02M 57/02 123/506
5,865,373 A * 2/1999 Buckley ..... F02M 57/02 239/533.8
5,873,527 A * 2/1999 Pattanaik ..... F02M 45/00 239/91
5,967,419 A * 10/1999 Yamaguchi ..... B05B 1/3053 239/397.5
6,113,000 A * 9/2000 Tian ..... F02M 47/027 239/533.8

(Continued)

FOREIGN PATENT DOCUMENTS

JP H08189442 A 7/1996

OTHER PUBLICATIONS

GB IPO, Search Report for GB 1906738.8. Published Jan. 15, 2020 by GB IPO Office, Entire Document.

*Primary Examiner* — Joseph A Greenlund
(74) *Attorney, Agent, or Firm* — Brannon Sowers & Cracraft

(57) ABSTRACT

A fuel system for an internal combustion engine includes a fuel system, a valve train, and a fuel injector including a cam actuated plunger. The fuel injector has a noise suppressor fluidly connecting a plunger cavity to each of a spill passage and a nozzle supply passage in the fuel injector. The noise suppressor has an inlet configuration forming a fuel admission flow area to the plunger cavity, and an outlet configuration forming a fuel discharge flow area. The fuel discharge flow area is smaller than the fuel admission flow area, and the noise suppressor adjusts to the outlet configuration to throttle discharging of fuel from the plunger cavity to limit valve train noise.

18 Claims, 4 Drawing Sheets

(56) References Cited

U.S. PATENT DOCUMENTS 6,119,960 A * 9/2000 Graves ..... F02M 45/06 137/625.65
6,354,270 B1 * 3/2002 Shafer ..... F02M 37/06 123/446
6,360,721 B1 * 3/2002 Schuricht ..... F02M 47/027 123/446
RE37,807 E 7/2002 Shinogle et al.
6,595,189 B2 * 7/2003 Coldren ..... F02M 45/00 123/459
6,647,964 B1 * 11/2003 Schuricht ..... F02M 45/08 123/446
6,655,603 B2 * 12/2003 Long ..... F02M 57/02 239/5
6,663,014 B1 * 12/2003 Depayva ..... F02M 47/027 239/88
6,793,159 B2 * 9/2004 Bloching ..... F02M 47/027 239/533.2
6,840,458 B2 * 1/2005 Kuzuyama ..... F02M 57/025 239/533.3
6,908,042 B2 * 6/2005 Kuzuyama ..... F02M 57/023 239/533.2
7,134,616 B2 * 11/2006 Dong ..... F02M 57/02 239/533.8
7,510,127 B2 * 3/2009 Haji ..... F02M 57/025 239/88
7,617,991 B2 * 11/2009 Wells ..... F02M 61/165 239/5
7,654,469 B2 * 2/2010 Boehland ..... F02M 45/06 239/88
7,744,015 B2 * 6/2010 McNichols ..... F02M 61/16 239/102.2
9,212,639 B2 * 12/2015 Kim ..... F02M 43/04
2002/0008157 A1 * 1/2002 Kuzuyama ..... F02M 59/102 239/88
2002/0092920 A1 * 7/2002 Augustin ..... F02M 45/06 239/88
2002/0148444 A1 * 10/2002 Hefler ..... F02M 63/0049 123/446
2004/0021013 A1 * 2/2004 Lawrence ..... F02M 61/182 239/533.12
2005/0194462 A1 * 9/2005 Coldren ..... F02M 59/366 239/88
2010/0096473 A1 * 4/2010 Coldren ..... F02M 63/0029 239/90
2012/0325926 A1 * 12/2012 Moore ..... F02M 63/0017 239/5
2014/0174405 A1 * 6/2014 Adachi ..... F02M 63/0054 123/472

* cited by examiner

FUEL INJECTOR AND FUEL SYSTEM WITH VALVE TRAIN NOISE SUPPRESSOR

TECHNICAL FIELD

The present disclosure relates generally to a fuel system for an internal combustion engine, and more particularly to a fuel injector in a fuel system having a noise suppressor.

BACKGROUND

A wide variety of fuel systems are well known and widely used in modern internal combustion engines. In some instances, fuel is pressurized for injection in a so-called common rail that stores a reservoir of pressurized fuel that is delivered to individual fuel injectors, typically in fluid communication directly with combustion cylinders in the engine. In other designs mechanical unit injectors each include a cam actuated plunger that pressurizes fuel for injection by one of a plurality of fuel injectors in the engine, or in some instances each plunger charges a pressure accumulator that stores pressurized fuel for less than all of the fuel injectors in the engine. Both types of systems have certain advantages and disadvantages.

In the case of mechanically actuated unit injectors the fuel system, and in particular the valve train, can be a significant source of undesirable engine noise. Depending upon jurisdictional requirements and variations engine to engine, noise produced by the engine can range from a relatively minor annoyance to an operating property that has to be managed. Specialized parts in the nature of ground gears, viscous dampers, and expensive noise panels can be required to reduce engine noise to acceptable levels. The use of such noise management equipment can add not only expense but also complexity, weight, packaging issues and other undesired properties to the engine.

U.S. Pat. No. 6,595,189 to Coldren et al. is directed to a method of reducing noise in a mechanically actuated fuel injection system. The strategy proposed by Coldren et al. employs a flow restriction between a fuel pressurization chamber of the fuel injector and a fuel source, ostensibly for the purpose of limiting momentum of fuel exiting the fuel injector past a spill valve. Sufficient momentum of such exiting fuel can produce physical separation followed by rapid reengagement of cooperating engine components. Coldren et al. indicates sufficient contact force can be maintained between the various engine components to reduce the mechanical noise levels. The strategy set forth in Coldren et al. appears to have applications for certain sources of excessive engine noise, however, there is always room for improvement and advancements in this field.

SUMMARY OF THE INVENTION

In one aspect, a fuel injector includes an injector body defining a fuel inlet, a nozzle outlet, a plunger cavity, a spill passage, and a nozzle supply passage. The fuel injector further includes a plunger movable within the plunger cavity between a retracted position, and an advanced position. An outlet check is movable within the injector body between a closed check position and an open check position to close or open the nozzle outlet to the nozzle supply passage. A spill valve is positioned within the spill passage and movable between a closed valve position to block the plunger cavity from the fuel inlet, and an open valve position. A noise suppressor fluidly connects the plunger cavity to each of the spill passage and the nozzle supply passage, the noise suppressor having an inlet configuration forming a fuel admission flow area to the plunger cavity, and an outlet configuration forming a fuel discharge flow area from the plunger cavity. The fuel discharge flow area is smaller than the fuel admission flow area, and the noise suppressor is adjustable from the inlet configuration to the outlet configuration to throttle discharging of fuel from the plunger cavity.

In another aspect, a fuel system for an internal combustion engine includes a fuel supply, a valve train, and a fuel injector fluidly connected with the fuel supply and including an outlet check, a spill valve, and a cam actuated plunger coupled with the valve train and movable from a retracted position toward an advanced position to pressurize a fuel for injection. The fuel injector further includes a noise suppressor fluidly connecting a plunger cavity to each of a spill passage and a nozzle supply passage in the fuel injector. The noise suppressor has an inlet configuration forming a fuel admission flow area to the plunger cavity, and an outlet configuration forming a fuel discharge flow area from the plunger cavity. The fuel discharge flow area is smaller than the fuel admission flow area. The noise suppressor is adjustable from the inlet configuration to the outlet configuration to throttle discharging of fuel from the plunger cavity.

In still another aspect, a method of operating a fuel system in an internal combustion engine includes pressurizing a plunger cavity in the fuel injector by advancing a plunger through the plunger cavity, and initiating depressurizing of the plunger cavity prior to the plunger reaching an end of stroke position. The method further includes throttling discharging of fuel from the plunger cavity after the initiating of the depressurizing of the plunger cavity, and suppressing valve train noise in the fuel system by way of the throttling of the discharging of fuel from the plunger cavity.

DETAILED DESCRIPTION

Figure 1:
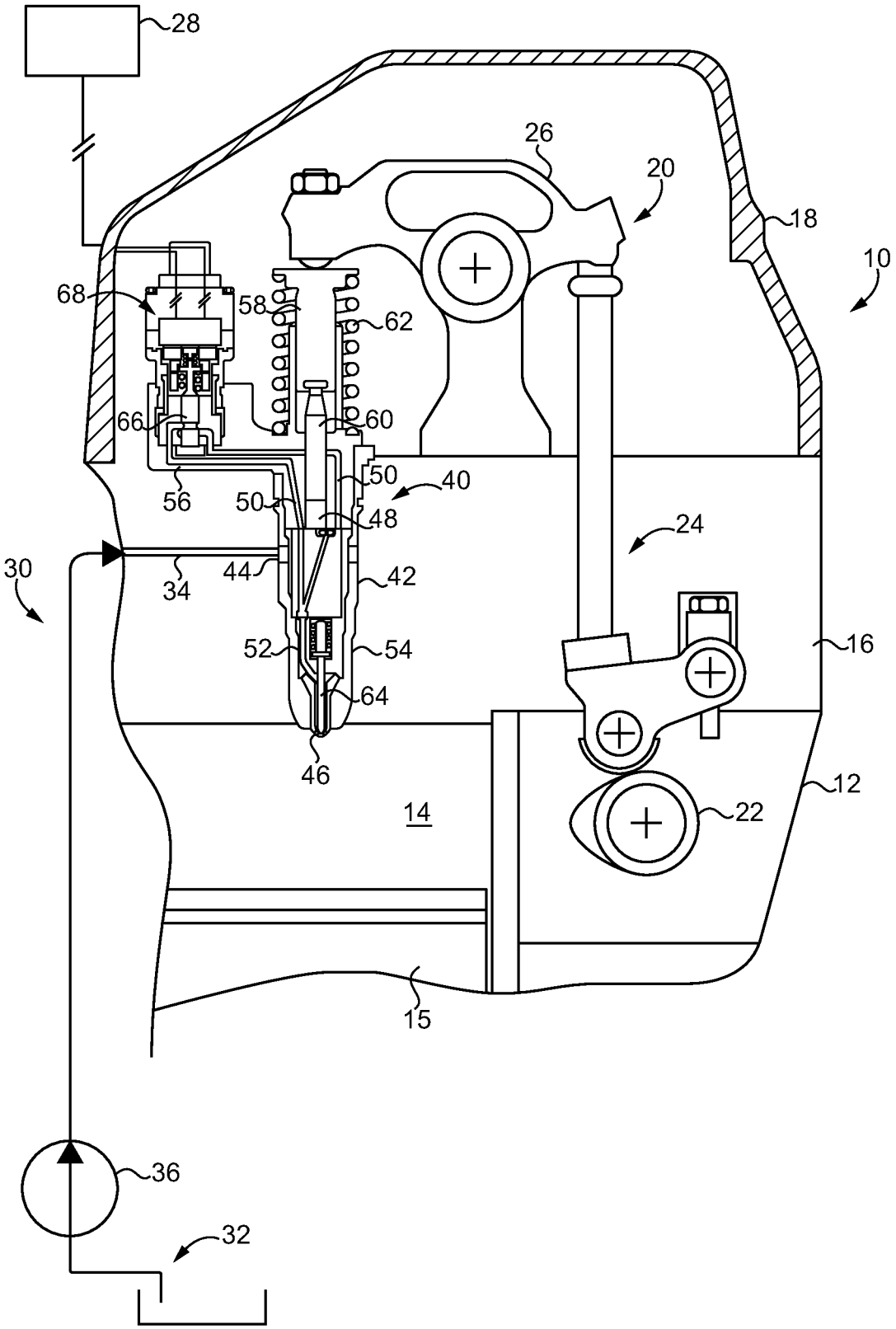
FIG. 1 is a partially sectioned side diagrammatic view of an engine system, according to one embodiment.

Referring to FIG. 1, there is shown an internal combustion engine system 10 (hereinafter "engine system 10"), according to one embodiment. Engine system 10 includes an engine housing 12 having a combustion chamber with a cylinder 14 formed therein. A piston 15 is movable within cylinder 14 between a top dead center position and a bottom dead center position in a generally conventional manner. In an implementation, engine system 10 will include a plurality of cylinders formed in engine housing 12, arranged in a V-configuration, an in-inline configuration, or in any other suitable arrangement, with each of the plurality of cylinders being equipped with a piston. Engine system 10 further includes an engine head 16 and a valve cover 18. A valve train 20 is covered with valve cover 18. Valve train 20 can include or be coupled with a rotatable cam 22 that is operable in response to movement of piston 15 to actuate a lifter assembly 24 in a generally conventional manner. Lifter assembly 24 causes a rocker arm 26 to reciprocate back and forth to pressurize a fuel, as further discussed herein. Engine system 10 may be structured as a compression ignition diesel engine operable on a suitable fuel such as a diesel distillate fuel, biodiesel, blended fuels, or potentially even as a so-called dual fuel engine utilizing both a liquid fuel and a gaseous fuel.

Engine system 10 further includes a fuel system 30 having a fuel supply 32 and a pump 36 structured to convey fuel to an inlet passage 34 formed in engine head 16. A fuel injector 40 is supported in engine head 16 and functions to pressurize a fuel in response to operation of rocker arm 26. It will be appreciated that a plurality of rocker arms in valve train 20 may be provided for actuating a plurality of identical or similar fuel injectors, with each of the plurality of fuel injectors positioned to inject a fuel into a corresponding cylinder 14. Engine head 16 may therefore include a plurality of inlet passages analogous to inlet passage 34 for supplying fuel to each of the plurality of fuel injectors. Drain passages or the like may also be provided to convey fuel not injected back to fuel supply 32 in a generally conventional manner. An electronic control unit 28 is shown in electrical control communication with fuel injector 40 for controlling functions thereof such as fuel pressurization and injection, as also further discussed herein. As will be further apparent from the following description, engine system 10 is structured for reduced noise, and in particular reduced noise produced by valve train 20, during operation.

Fuel injector 40 includes an injector body 42 defining a fuel inlet 44, a nozzle outlet 46, a plunger cavity 48, and a spill passage 50. Fuel inlet 44, which may include a plurality of fuel inlets, can connect to inlet passage 34, which may form a fuel supply anulus extending circumferentially around injector body 42 within engine head 16. Nozzle outlet 46 may fluidly communicate with cylinder 14 and can include a plurality of spray orifices in some embodiments, with injector body 42 extending into cylinder 14. In an implementation, injector body 42 includes a casing 54, and a body piece 56, structured as a side car in the illustrated embodiment. A tappet 58 may be coupled with injector body 42 and movable in response to movement of rocker arm 26. A return spring 62 can bias tappet 58 away from injector body 42 and also bias rocker arm 26 toward rotation away from fuel injector 40, in a clockwise direction in the FIG. 1 illustration.

Injector body 42 further defines a nozzle supply passage 52. A plunger 60 is movable within plunger cavity 48 between a retracted position, and an advanced position and actuated in response to rotation of cam 22, and upward and downward travel of lifter assembly 24. An outlet check 64 is movable within injector body 42 between a closed check position and an open check position to close or open nozzle outlet 46 to nozzle supply passage 52. Outlet check 64 can include a known spring biased needle check opening in response to hydraulic pressure within injector body 42 and in nozzle supply passage 52 that overcomes a closing biasing force of a check biasing spring (not numbered). In other implementations outlet check 64 could be directly controlled, with fuel injector 40 including an electrical injection control valve structured to vary a closing hydraulic pressure on a closing hydraulic surface of the direct operated outlet check. A spill valve 66 is positioned within spill passage 50 and movable between a closed valve position to block plunger cavity 48 from fuel inlet 44 and an open valve position. An electrical spill valve actuator 68 changes its energy state in response to a control signal, such as a control current, from electronic control unit 28 to move spill valve 66 between the open valve position and the closed valve position.

Figure 2:
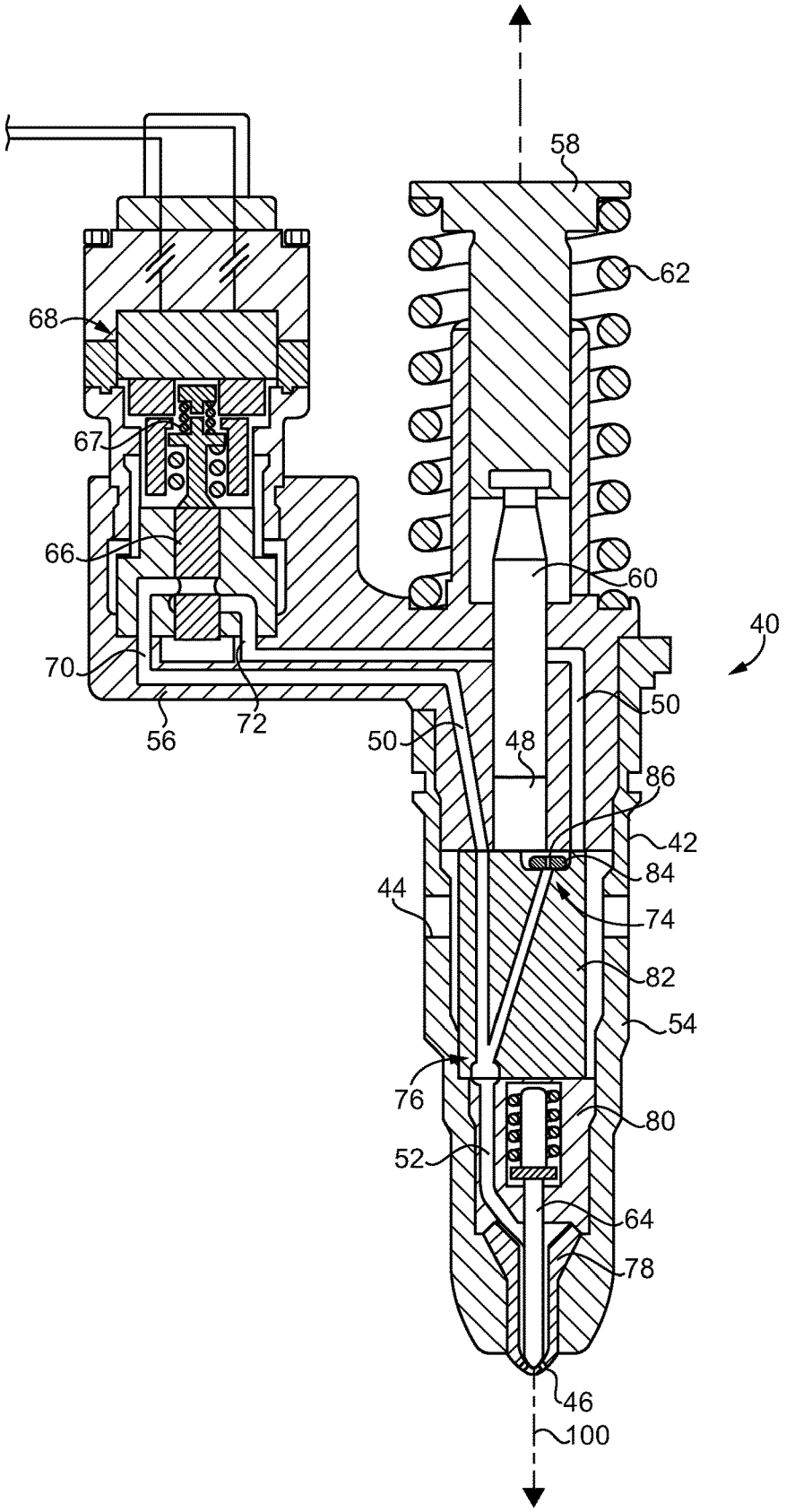
FIG. 2 is a partially sectioned side diagrammatic view of a fuel injector, according to one embodiment.

Referring also now to FIG. 2, in the illustrated embodiment, spill valve 66 is positioned fluidly between a spill passage segment 70 and another spill passage segment 72. Spill valve 66 may be spring biased open to fluidly connect spill passage segment 70 to spill passage segment 72, such that so long as spill valve actuator 68 is in a first electrical energy state, such as a deenergized state, movement of plunger 60 between its retracted position and its advanced position pumps fuel into and out of plunger cavity 48 without substantially affecting pressure of the pumped fuel nor initiating fuel injection. When spill valve actuator 68 receives an appropriate control signal, such as a control current, from electronic control unit 28, spill valve 66 is moved to the closed valve position to block plunger cavity 48 from fuel inlet 44, and cause a pressure of fuel within plunger cavity 48 to be increased as plunger 60 is moved from its retracted position toward its advanced position. When the pressure of fuel within plunger cavity 48 reaches a high enough level, outlet check is urged open by the hydraulic pressure to enable fuel to spray out of nozzle outlet 46 into cylinder 14. When spill valve 66 is once again deenergized, or otherwise its electrical energy state is appropriately changed, spill valve 66 can return toward an open position, a downward position in the FIG. 2 illustration, to reestablish fluid communication between spill passage segment 70 and spill passage segment 72. Reopening of the fluid communication can result in outlet check 64 returning to its closed check position to shut off fuel injection, and commencing of depressurizing of plunger cavity 48.

It is typical for end of fuel injection to be timed such that spill valve 66 is opened prior to a point in time at which plunger 60 has reached an advanced end of stroke position. According to known principles, when spill valve 66 opens the depressurization of plunger cavity 48 can cause plunger 60 to accelerate such that tappet 58 comes out of contact with rocker arm 26 and/or components come out of contact with one another elsewhere in valve train 20 or an associated engine geartrain, and/or still other undesired phenomena occur. It will be appreciated that separation of contact between components and reestablishing of contact between components in a dynamic and relatively highly spring biased valve train, generation of mechanical strain or vibrations, or still other phenomena can produce significant noise. As suggested above this noise tends to be challenging and/or expensive to manage.

Fuel injector 40 is equipped with a noise suppressor 74 fluidly connecting plunger cavity 48 to each of spill passage 50 and nozzle supply passage 52. Noise suppressor 74 has an inlet configuration forming a fuel admission flow area to plunger cavity 48, and an outlet configuration forming a fuel discharge flow area from plunger cavity 48. The fuel discharge flow area is smaller than the fuel admission flow area, and noise suppressor 74 is adjustable from the inlet configuration to the outlet configuration to throttle discharging of fuel from plunger cavity 48. Throttling the discharging of fuel from plunger cavity 48 can retard depressurization of plunger cavity 48 such that components in valve train 20 and/or the associated geartrain do not come out of contact with one another. The positioning of noise suppressor 74 enables throttling of the flow and retention of fluid pressure in plunger cavity 48 when plunger 60 approaches an end of stroke position without also affecting operation of outlet check 64, as might occur in a design where a spill passage or spill valve itself provides the flow throttling.

Figure 3:
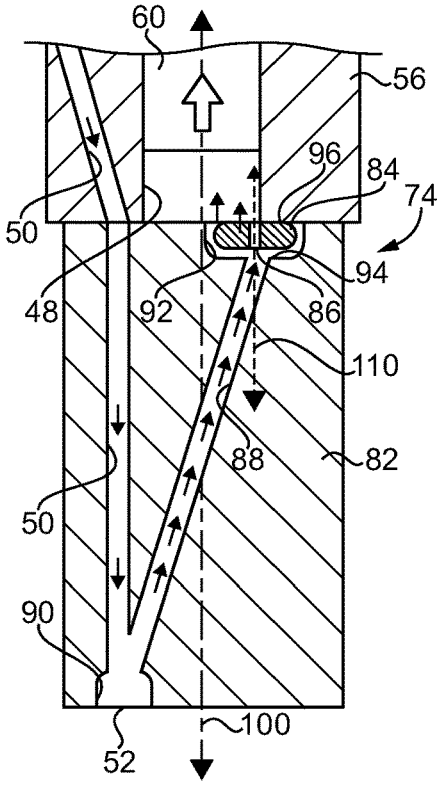
FIG. 3 is a sectioned side diagrammatic view of a portion of the fuel injector of FIG. 2 illustrating a noise suppressor in a first configuration.

Fuel injector 40 further includes a stack 76 positioned at least partially within casing 54, and having a plurality of stack components 78, 80, 82 positioned within injector body 42. Noise suppressor 74 may include an assembly of one of the plurality of stack components 82 and a flow restrictor 84 having a flow throttling orifice 86 formed therein. In FIG. 2 noise suppressor 74 is shown as it might appear in the outlet configuration. Referring also now to FIG. 3 there is shown a close-up view illustrating additional features of noise suppressor 74 and in further detail. There can be seen the one of the plurality of stack components 82, which can include a substantially cylindrical stack piece, with flow restrictor 84 positioned at least partially within a well 92 formed in component 82. It can also be noted from FIG. 3 that a longitudinal injector body axis 100 extends generally down a center line of component 82 and the adjacent component 56. Plunger cavity 48 is formed in part by component 56 and in part by component 82, and also in part by flow restrictor 84 itself. A portion of spill passage 50 extends through component 82, and component 82 further forms a common fluid connection 88, that includes an inlet/outlet passage, of plunger cavity 48 to each of spill passage 50 and nozzle supply passage 52 such that spill passage 50 and nozzle supply passage 52 are arranged fluidly in parallel relative to plunger cavity 48. A junction 90 is formed between spill passage 50 and nozzle supply passage 52. In one embodiment, junction 90 can include a bathtub connection having the characteristic basin or bathtub shape depicted in the drawings. As mentioned above component 82 has a well 92 formed therein, and flow restrictor 84 is positioned at least partially within well 92.

In FIG. 3 noise suppressor 74 is shown as it might appear in the inlet configuration. Component 56 has a bottom surface 96, and flow restrictor 84 is trapped between component 82 and component 56, and movable between a first stop position in contact with component 82, as shown in FIG. 1, and a second stop position in contact with component 56. At the first stop position flow restrictor 84 can block a seat 94, such as a flat seat, that extends circumferentially around inlet/outlet passage 88. At the second stop position flow restrictor 84 can contact bottom surface 96. It can be seen that flow restrictor 84 defines a disc plate center axis 110 that is radially offset from longitudinal injector body axis 100. At each of the first stop position and the second stop position flow throttling orifice 86 can provide fluid communication between inlet/outlet passage 88 and plunger cavity 48. At the first stop position, where flow restrictor 84 blocks seat 94, the sole fluid communication between inlet/outlet passage 88 and plunger cavity 48 can be by way of flow throttling orifice 86. At the second stop position, as shown in FIG. 3, in addition to the fluid communication provided by flow throttling orifice 86 fluid communication also exists extending around and past flow restrictor 84. It will thus be understood that a fluid flow area into plunger cavity 48, the fuel admission flow area explained above, can be slightly larger than the flow area out of plunger cavity 48, the fuel discharge flow area explained above, based on the adjusting of noise suppressor 74 between the inlet configuration and the outlet configuration. The fuel admission flow area is thus defined by component 82 and flow restrictor 84, whereas the fuel discharge flow area is defined by flow restrictor 84 only. Flow restrictor 84 can thus be understood to behave somewhat analogously to a check valve but permitting discharge of flow through flow throttling orifice 86. In an implementation, flow restrictor 84 includes a disc plate having flow throttling orifice 86 centrally arranged therein. Other embodiments could include a different flow restrictor design, multiple flow restrictors or multiple orifices, positioning of flow restrictor 84 between different stack components, or still another arrangement. Arrows in FIG. 3 illustrate example flow direction from spill passage 50, into the fluid connection formed by inlet/outlet passage 88, and into plunger cavity 48.

Figure 4:
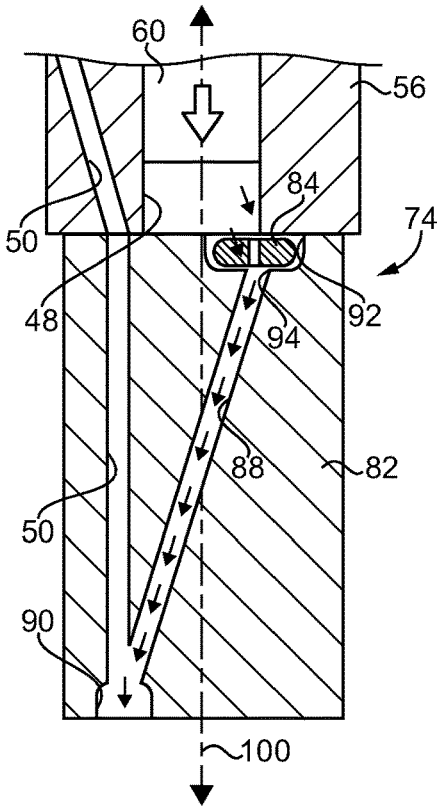
FIG. 4 is a sectioned side diagrammatic view of the portion of the fuel injector showing the noise suppressor in a second configuration.

Referring also now to FIG. 4, there is shown noise suppressor 74 as it might appear where beginning to move from its inlet configuration to its outlet configuration. In FIG. 3 plunger 60 may be moving upward toward a retracted position. In FIG. 4 plunger 60 may instead be moving downward toward an advanced, end of stroke position. Travel of plunger 60 between its retracted position and its advanced position can affect the position of flow restrictor 84 and its moving between the first stop position and the second stop position. Accordingly, flow restrictor 84 may move from the first stop position toward the second stop position in response to movement of plunger 60 toward its retracted position and can move from the second stop position back toward the first stop position in response to movement of plunger 60 toward its advanced position. Flow restrictor 84 and flow throttling orifice 86 may have sizes tuned to provide desired results. It will typically be desirable to fill plunger cavity 48 sufficiently for fuel injection, when plunger 60 is moving toward its retracted position in response to movement of rocker arm 26. It will further be desirable for flow throttling orifice 86 to be sized to minimize pressure loss between plunger cavity 48 and a sac (not numbered) in injector body 42 and fluidly connecting with nozzle outlet 46. It is also desirable that orifice 86 be connected in such a way as to not change end of injection characteristics, including the ability to rapidly and steeply cut off fuel injection so as to avoid so-called dribble or other undesired phenomena. Further still, it is desirable that orifice 86 be sized to create some level of back pressure within plunger cavity 48 at the end of injection. The back pressure can be understood to create a damping effect on valve train 20, and potentially an adjacent and associated geartrain in engine system 10, to enable geartrain noise and valve train noise to be limited while reducing cost as compared to other noise suppression strategies.

INDUSTRIAL APPLICABILITY

When no fuel injection is desired spill valve 66 can be maintained in the open position such that plunger 60 moves between the advanced position and retracted position to passively move fuel back and forth from and to fuel inlet 44. When fuel injection is desired, plunger cavity 48 can be pressurized as described herein by advancing plunger 60 through plunger cavity 48 toward its advanced position with spill valve 66 closed. Increased hydraulic pressure in fuel injector 40 can act upon outlet check 64 to cause outlet check 64 to open and fuel to spray out of nozzle outlet 46. When ending of fuel injection is desired, depressurizing plunger cavity 48 can be initiated by opening spill valve 66. As discussed herein the opening of spill valve 66 can be relatively rapid and can occur prior to plunger 60 reaching an advanced end of stroke position. With spill valve 66 open pressure in fuel injector 40 will decrease and outlet check 64 can close to block nozzle outlet 46. As also discussed herein, in prior designs the rapid depressurization of the plunger cavity could have a tendency to produce excessive noise.

According to the present disclosure, discharging of fuel from plunger cavity 48 after opening spill valve 66 and initiating the depressurizing of plunger cavity 48 can be throttled by way of noise suppressor 74 as flow restrictor 84 reaches the second stop position blocking seat 94. As a result the returning of energy stored in fuel injector 40 to valve train 20 and an associated geartrain, can be slowed such that noise is reduced.

Figure 5:
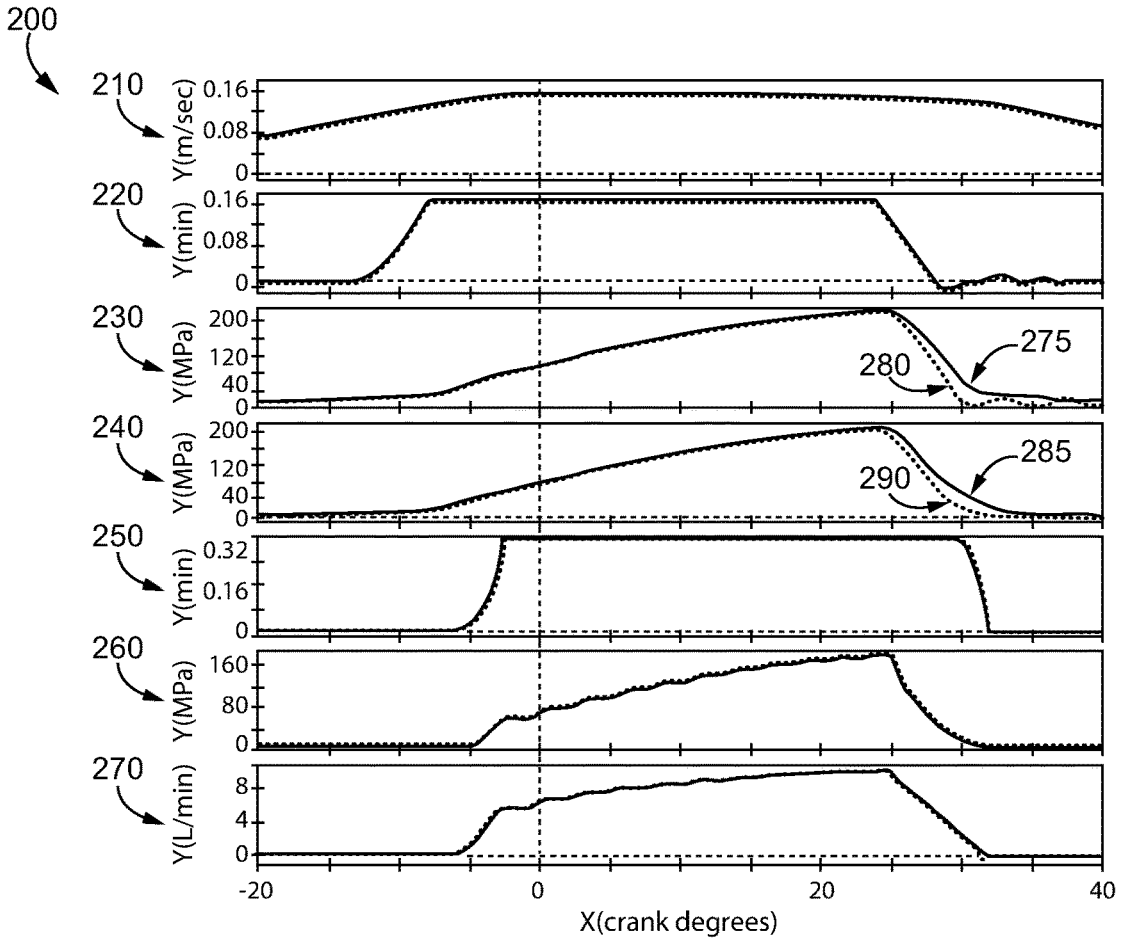
FIG. 5 shows a group of signal traces illustrating fuel system operating parameters, according to the present disclosure in comparison with an existing design.

Referring now to FIG. 5, there is shown a chart 200 illustrating various engine and fuel system operating properties for a known design without a noise suppressor in dashed line, and for an engine and fuel system having a noise suppressor according to the present disclosure in solid line. At 210 a signal trace shows cam velocity in meters per second on the Y-axis, and crank angle on the X-axis. At 220 is shown spill valve linear displacement in millimeters on the Y-axis, with crank angle on the X-axis. At 230 is shown a rocker pressure in MegaPascals on the Y-axis and crank angle on the X-axis. Reference numeral 275 points to a portion of the signal trace of the present disclosure that might be observed as the plunger approaches an advanced end of stroke position. Reference numeral 280 points to an analogous portion of the signal trace for the known design. At 240 is shown a plunger cavity pressure in MegaPascals on the Y-axis in comparison with crank angle on the X-axis. Reference numeral 290 identifies what might be observed in a known design, in comparison with a design according to the present disclosure shown at 285, as a plunger approaches an advanced end of stroke position. At 250 is shown an outlet check position in millimeters on the Y-axis in comparison with crank angle on the Y-axis. Trace 260 illustrates sac pressure in MegaPascals on the Y-axis in comparison with crank angle on the X-axis, whereas trace 270 shows outlet check seat volumetric fuel flow in liters per minute on the Y-axis in comparison with crank angle on the X-axis.

It can be noted from traces 210, 220, 250, trace 260, and trace 270 that expected observations are similar between the known design and the design according to the present disclosure. In traces 230 and 240, however, several differences are evident. Depressurization of the plunger cavity tends to be more gradual in the design according to the present disclosure as evident in trace 240. Analogously the rocker pressure depicted in trace 230 reduces more gradually. It can still further be noted that rocker pressure oscillations observed in the known design, shown as successive humps beginning at about 30 degrees crank angle, are not apparent in the design according to the present disclosure.

Figure 6:
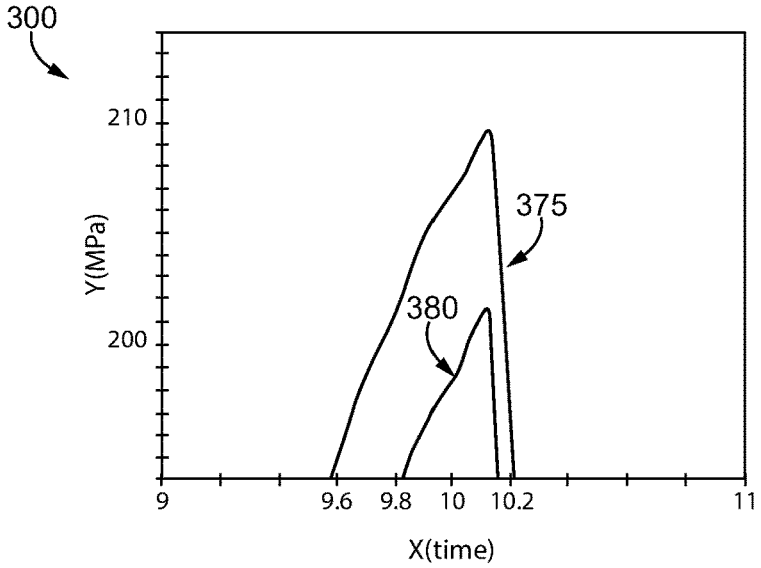
FIG. 6 is another chart illustrating example features of fuel system operation according to the present disclosure in comparison with an existing design.

Referring now to FIG. 6, there is shown a graph 300 illustrating pressure in MegaPascals on the Y-axis in comparison to time in milliseconds on the X-axis for a known design 380 in comparison with a design according to the present disclosure 375. Graph 300 represents what might be observed for plunger cavity pressures just prior to and just after opening the spill valve. Line 380 shows the pressure rapidly increasing from about time t=9.8 milliseconds to about time t=10.1 milliseconds then rapidly dropping off in response to spill valve opening. Line 375 shows the pressure rapidly increasing from about time t=9.6 milliseconds to about time t=10.2 milliseconds and then rapidly dropping off in response to spill valve opening. It can be noted that the peak pressures employing a noise suppressor according to the present disclosure may be somewhat higher, for example about 4% higher, than in the known design, due to the throttling of the outflow of pressurized fuel. It can therefore also be appreciated that producing and retaining this greater fluid pressure in the plunger cavity in comparison to a known design can limit a tendency for plunger cavity pressure to drop to the point that separation of valve train or geartrain components occurs.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an injector body defining a fuel inlet, a nozzle outlet, a plunger cavity, a spill passage, and a nozzle supply passage;

a plunger movable within the plunger cavity between a retracted position, and an advanced position;

an outlet check movable within the injector body between a closed check position and an open check position to close or open the nozzle outlet to the nozzle supply passage;

an electrically actuated spill valve positioned within the spill passage and movable between a closed valve position where the electrically actuated spill valve blocks the plunger cavity from the fuel inlet, and an open valve position where the electrically actuated spill valve does not block the plunger cavity from the fuel inlet and the plunger cavity is in fluid communication with the fuel inlet:

a noise suppressor fluidly connecting the plunger cavity to each of the spill passage and the nozzle supply passage, the noise suppressor having an inlet configuration forming a fuel admission flow area to the plunger cavity, and an outlet configuration forming a fuel discharge flow area from the plunger cavity to the spill passage and the nozzle supply passage; and the fuel discharge flow area being smaller than the fuel admission flow area, and the noise suppressor being adjustable to the outlet configuration to throttle discharging of fuel from the plunger cavity and the noise suppressor including the flow restrictor is movable between a first stop position in contact with a first surface and a second stop position in contact with a second surface, the flow restrictor having an orifice wherein in the first stop position fuel flows around the restrictor and through the orifice and in the second stop position fuel flows through the orifice.

2. The fuel injector of claim 1 further comprising a stack having a plurality of stack components positioned within the injector body, and wherein the noise suppressor includes an assembly of one of the plurality of stack components and the flow restrictor having the orifice formed therein, wherein the orifice is a flow throttling orifice.

3. The fuel injector of claim 2 wherein the noise suppressor forms a common fluid connection of the plunger cavity to each of the spill passage and the nozzle supply passage such that the spill passage and the nozzle supply passage are arranged fluidly in parallel relative to the plunger cavity.

4. The fuel injector of claim 3 wherein the flow restrictor is trapped between the one of the plurality of stack components and a second component in the injector body.

5. The fuel injector of claim 4 wherein:

the injector body defines a longitudinal injector body axis; and the flow restrictor includes a disc plate having the flow throttling orifice centrally arranged therein and defining a disc plate center axis that is radially offset from the longitudinal injector body axis.

6. The fuel injector of claim 4 wherein:

the noise suppressor is in the outlet configuration when the flow restrictor is at the first stop position, and in the inlet configuration when the flow restrictor is at the second stop position.

7. The fuel injector of claim 4 wherein the one of the plurality of stack components has a well formed therein, and the flow restrictor is positioned at least partially within the well.

8. The fuel injector of claim 3 wherein the common fluid connection includes an inlet/outlet passage formed in the one of the plurality of stack components and extending between the plunger cavity and a junction of the nozzle supply passage and the spill passage.

9. The fuel injector of claim 8 wherein the junction includes a bathtub connection formed by the one of the plurality of stack components.

10. The fuel injector of claim 1 further comprising a cam-actuated tappet coupled with the plunger.

11. A fuel system for an internal combustion engine comprising:

a fuel supply; a valve train;

a fuel injector fluidly connected with the fuel supply and including an outlet check, an electrically actuated spill valve, and a cam actuated plunger coupled with the valve train and movable from a retracted position toward an advanced position to pressurize a fuel for injection;

the fuel injector further including a noise suppressor fluidly connecting a plunger cavity to each of a spill passage and a nozzle supply passage connecting to a fuel inlet in the fuel injector;

the electrically actuated spill valve being positioned within the spill passage, and movable between a closed valve position where the electrically actuated spill valve blocks the plunger cavity from the fuel inlet and an open valve position where the electrically actuated spill valve does not block the plunger cavity from the fuel inlet and the plunger cavity is in fluid communication with the fuel inlet:

the noise suppressor having an inlet configuration forming a fuel admission flow area to the plunger cavity, and an outlet configuration forming a fuel discharge flow area from the plunger cavity to the spill passage and the nozzle supply passage, the fuel discharge flow area being smaller than the fuel admission flow area; and the noise suppressor being adjustable to the outlet configuration, to throttle discharging of fuel from the plunger cavity and the noise suppressor including the flow restrictor is movable between a first stop position in contact with a first surface and a second stop position in contact with a second surface, the flow restrictor having an orifice wherein in the first stop position fuel flows around the restrictor and through the orifice and in the second stop position fuel flows through the orifice.

12. The fuel system of claim 11 wherein:

the fuel injector includes a plurality of stack components positioned within a casing of an injector body; and the noise suppressor includes an assembly of one of the plurality of stack components.

13. The fuel system of claim 12 wherein the fuel admission flow area is defined by the one of the plurality of stack components and the flow restrictor, and the fuel discharge flow area is defined by the flow restrictor.

14. The fuel system of claim 13 wherein the flow restrictor includes a disc plate having the orifice formed therein, wherein the orifice is a flow throttling orifice.

15. The fuel system of claim 14 wherein:

the flow restrictor is trapped between the one of the plurality of stack components and a second one of the plurality of stack components:

the noise suppressor is in the outlet configuration when the flow restrictor is at the first stop position, and in the inlet configuration when the flow restrictor is at the second stop position.

16. The fuel system of claim 15 wherein the one of the plurality of stack components has a well formed therein, and the flow restrictor is positioned at least partially within the well.

17. The fuel system of claim 16 wherein a seat is formed within the well and contacted by the flow restrictor at the first stop position, and the common fluid connection includes an inlet/outlet passage formed in the one of the plurality of stack components and extending between the seat and a junction of the nozzle supply passage and the spill passage.

18. The fuel system of claim 17 wherein the junction of the nozzle supply passage and the spill passage is formed by the one of the plurality of stack components.

* * * * *